US008960518B2

(12) United States Patent
Weigmann et al.

(10) Patent No.: US 8,960,518 B2
(45) Date of Patent: Feb. 24, 2015

(54) DEVICE FOR SETTING FASTENERS

(75) Inventors: Torsten Weigmann, Ronnenberg (DE); Olaf Hahndel, Pattensen (DE)

(73) Assignee: Illinois Tool Works Inc., Glenview, IL (US)

( * ) Notice: Subject to any disclaimer, the term of this patent is extended or adjusted under 35 U.S.C. 154(b) by 824 days.

(21) Appl. No.: 13/143,746

(22) PCT Filed: Jan. 8, 2010

(86) PCT No.: PCT/EP2010/000054

§ 371 (c)(1),
(2), (4) Date: Sep. 26, 2011

(87) PCT Pub. No.: WO2010/079136

PCT Pub. Date: Jul. 15, 2010

(65) Prior Publication Data

US 2012/0006878 A1 Jan. 12, 2012

(30) Foreign Application Priority Data

Jan. 8, 2009 (DE) ..... 20 2009 000 193
Dec. 15, 2009 (DE) ..... 20 2009 016 878

(51) Int. Cl.
*B25C 1/00* (2006.01)
*B25C 5/16* (2006.01)

(52) U.S. Cl.
CPC ..... *B25C 5/1665* (2013.01); *B25C 1/00* (2013.01)
USPC ..... 227/123; 227/127; 227/142

(58) Field of Classification Search
USPC ..... 227/123, 120, 130, 142, 127, 128, 8, 227/140
See application file for complete search history.

(56) References Cited

U.S. PATENT DOCUMENTS 3,273,777 A * 9/1966 Juilfs et al. ..... 227/123
3,934,778 A * 1/1976 Males ..... 227/123
5,667,127 A 9/1997 Ichikawa et al.
6,056,182 A * 5/2000 Chen ..... 227/123
6,076,722 A * 6/2000 Huang ..... 227/123
6,325,268 B1 12/2001 Liang (Continued)

FOREIGN PATENT DOCUMENTS

DE 3715293 C2 11/1991

OTHER PUBLICATIONS

ISR for PCT/EP2010/000054 dated May 20, 2010.

(Continued)

*Primary Examiner* — Scott A. Smith
(74) *Attorney, Agent, or Firm* — Lowe Hauptman & Ham LLC

(57) ABSTRACT

The invention relates to a device for setting fasteners, in particular a driving tool, comprising at least one striking pin for a particular fastener, wherein the striking pin and the fastener to be set by the striking pin are guided at least in some sections in a channel, which comprises at least one stationary channel part and a channel closure flap arranged so as to be pivotable relative to the channel part. The channel closure flap is held at the upper end thereof by an eccentric shaft that can be adjusted about the rotational axis, wherein the closure flap comprises at least one holding part corresponding to the channel part for forming a lock. The eccentric shaft preferably comprises two end sections oriented coaxially to each other and a center part arranged eccentrically to the end sections, wherein the closure flap is rotatably mounted on the center part of the eccentric shaft.

27 Claims, 5 Drawing Sheets

(56) References Cited

U.S. PATENT DOCUMENTS

Figure 1:
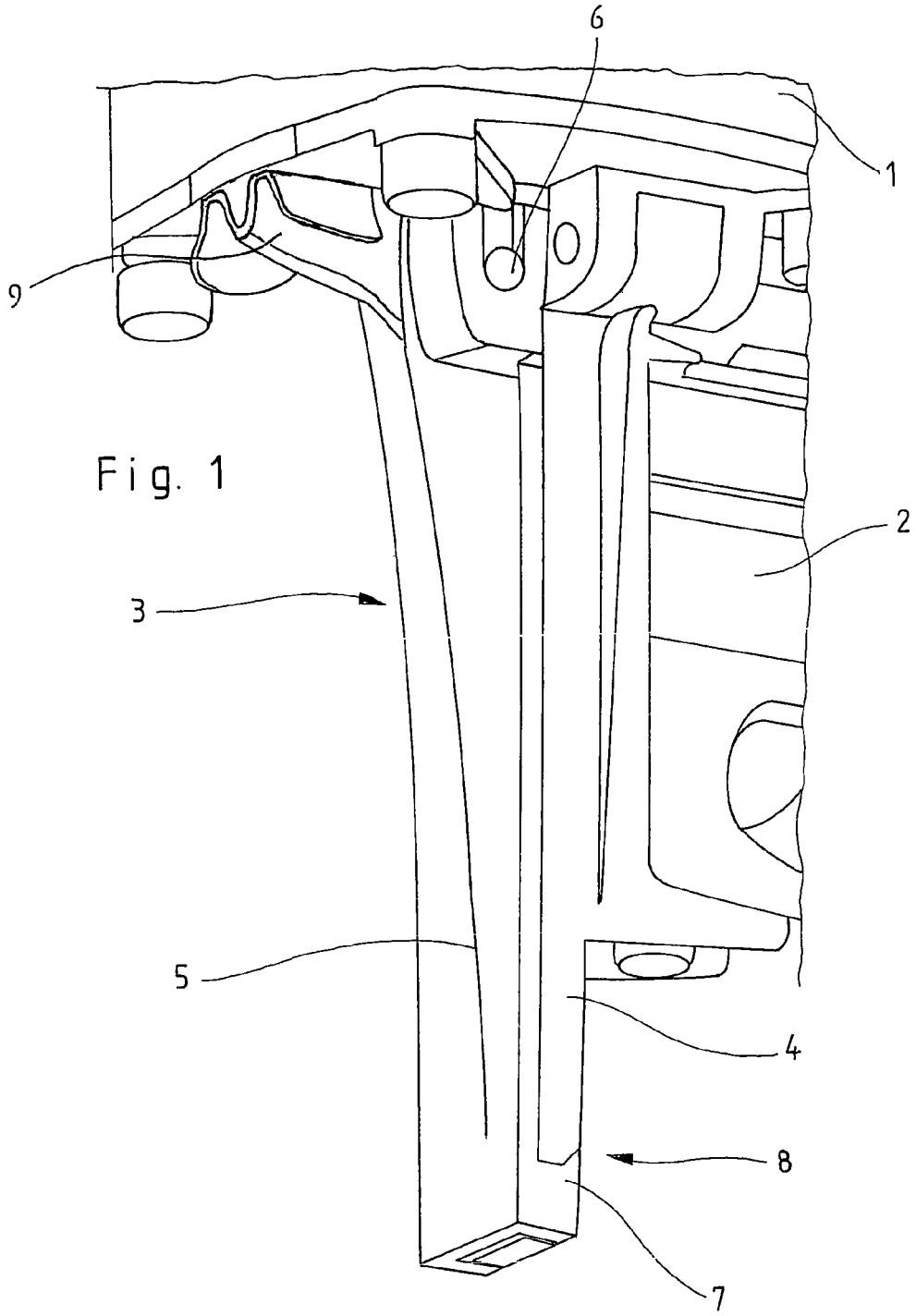

| | | | | |
|---|---|---|---|---|
| 6,409,068 | B1 * | 6/2002 | Lee | 227/123 |
| 6,598,776 | B2 * | 7/2003 | Adachi et al. | 227/123 |
| 6,763,989 | B2 * | 7/2004 | Wang | 227/123 |
| 6,786,380 | B2 * | 9/2004 | Driscoll et al. | 227/127 |
| 6,929,165 | B1 * | 8/2005 | Chen et al. | 227/8 |
| 7,032,796 | B1 * | 4/2006 | Lin | 227/123 |
| 7,083,074 | B2 | 8/2006 | Chen | |
| 7,464,843 | B2 * | 12/2008 | Huang | 227/8 |
| 7,922,054 | B2 * | 4/2011 | Cole, Jr. | 227/8 |
| 2005/0145669 | A1 | 7/2005 | Chen | |
| 2006/0191973 | A1 | 8/2006 | Chen et al. | |

OTHER PUBLICATIONS

Search Report for German Patent Application No. 20 2009 000 193.8, Jan. 8, 2010.

* cited by examiner

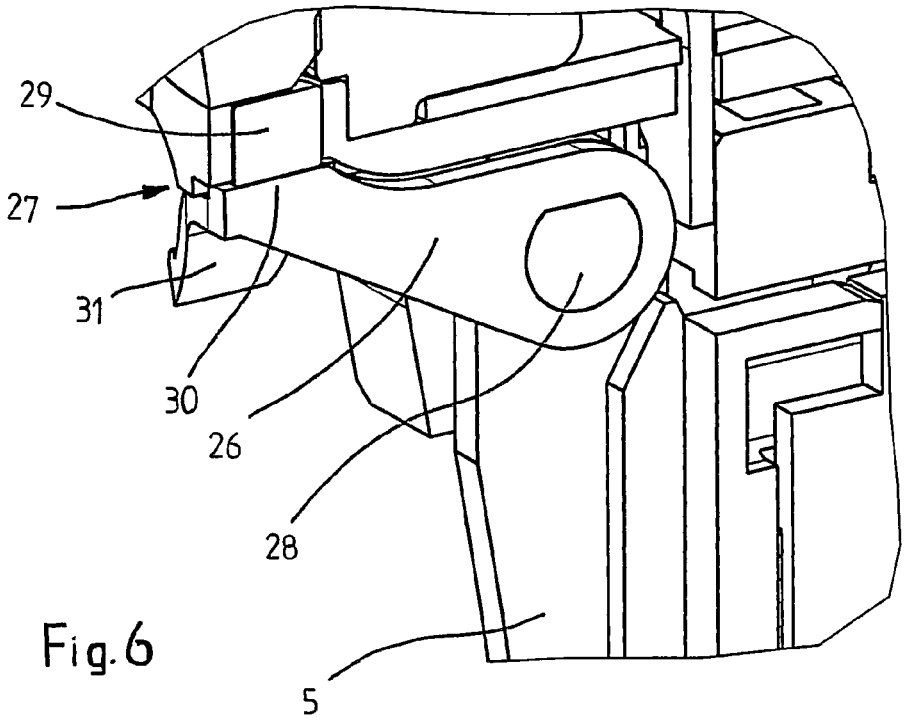
Fig. 6
Fig. 7
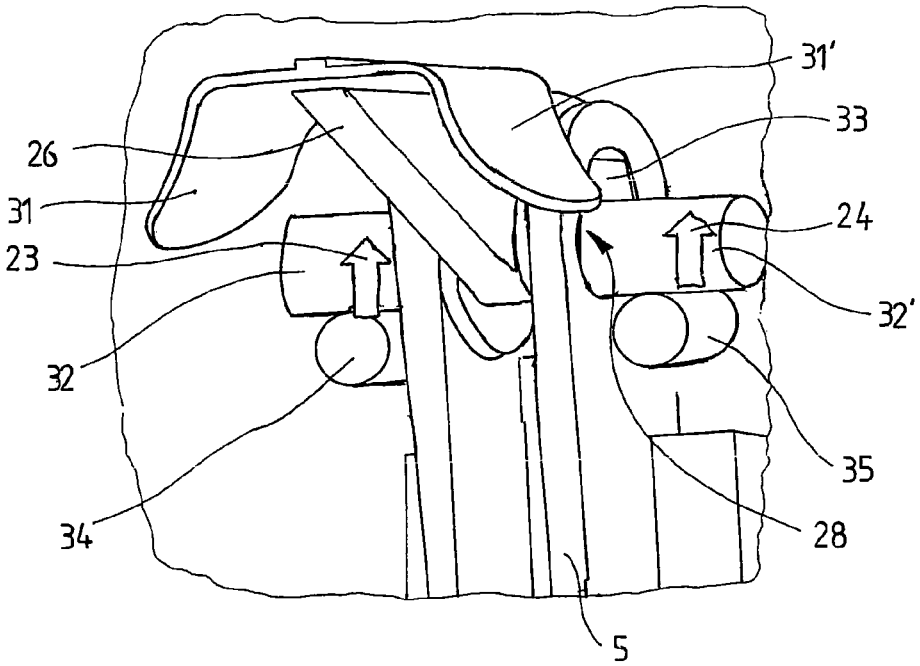

DEVICE FOR SETTING FASTENERS

RELATED APPLICATIONS

The present application is national phase of PCT/EP2010/000054 filed Jan. 8, 2010, and claims priority from German Application Number 202009000193.8 filed Jan. 8, 2009, and German Application Number 202009016878.6 filed Dec. 15, 2009.

The invention relates to a device for setting fasteners, in particular to a driving unit, having at least one striking pin for a respective fastener, the striking pin and the fastener to be set by means of the striking pin being guided at least in sections in a channel which is formed from at least one stationary channel part and a channel closure flap which is arranged such that it can be moved pivotably with respect to the channel part.

Devices of the known generic type, such as pulse, compressed air or electric driving units or else manually actuable driving units, are used, inter alia, for setting or pressing in fasteners, such as clips, nails or the like, into a solid substrate, in order for it to be possible to clip or fasten, for example, materials to furniture items to be refurbished or a tarpaulin material to a wall section or a roof layer of a building. To this end, driving units of this type generally have a striking pin which is to be actuated by means of triggers and via which the fasteners which are usually accommodated in a magazine or the stored fasteners are driven one after another into material layers which are to be connected in each case to one another. Here, the fastener is pushed in a guide channel in front of the striking pin which moves at high speed in the direction of the material layers, a respective fastener being driven as far as the head or its upper end into the material layers. It can occasionally occur that a fastener is twisted or wedged within the guide channel, with the result that disruptions occur in the function of devices of this type. In order for it to be possible to remove the jammed fastener out of the guide channel, the latter has a two-part design in some embodiments, comprising at least one stationary channel part and a channel closure flap which is arranged on the former such that it can be moved pivotably. The closure flap is frequently arrested by means of a locking means which is formed approximately half way up the channel part, can be released in the case of a disruption and the closure flap can then be pivoted upward or to the side. Free access into the interior of the guide channel which can be opened is therefore ensured.

In devices of the above-described generic type, the locking means which is usually formed half way along the guide channel may result in an impairment of the visibility of the free end of the guide channel which is to be placed onto the material layers, which has a disruptive effect, in particular, on the precise setting of the fasteners. Moreover, the closure flap on the channel part can be distorted in some circumstances after relatively long use, as a result of the locking means which is often formed on only one of the longitudinal sides of the closure flap, which results in an enlargement of the guide channel and therefore in turn in increased jamming or wedging of fasteners in the guide channel.

The invention is based on the object of improving a device of the above-described generic type in such a way that no impairment in the handling of the device is produced as a result of the locking means for the closure flap, and a permanently optimum locking function for the closure flap on the stationary channel part is brought about.

According to the invention, the object is achieved by a device having the features of patent claim 1. Advantageous developments and refinements are specified in claims 2 to 9.

In a device for setting fasteners, in particular a driving unit, having at least one striking pin for a fastener which is, in particular, stored, the striking pin and the fastener to be set by means of the striking pin being guided at least in sections in a channel which is formed from at least one stationary channel part and a channel closure flap which is arranged such that it can be moved pivotably with respect to the channel part, it is provided according to the invention that the channel closure flap is received at its upper end by means of an eccentric shaft which can be adjusted about the rotational axis, and that the closure flap has at least one holding part which corresponds with the channel part in order to form a locking means.

One advantageous refinement of the guide channel for the fasteners which are guided therein is implemented with the aid of a channel closure flap which is received according to the invention, is mounted pivotably at its upper end via an eccentric shaft which can be adjusted about its rotational axis, and, at its lower end, additionally has at least one holding part which corresponds, for example, positively with the stationary channel part, for forming a locking means of the two components among one another which form the guide channel. As a result of the modified outer contour of the guide channel which no longer has an outer disruptive contour, there is no longer an impairment of the visibility of its free end, which advantageously simplifies, in particular, the handling of the device which is formed according to the invention and, correspondingly, the setting of the fasteners. Furthermore, the receiving by means of an eccentric shaft has the advantage that, in the case of a fastener which is twisted or jammed in the interior of the guide channel, a gap is produced between the channel closure flap and the stationary channel part as a result of the rotation of the eccentric shaft, in particular out of its top dead center. In addition, an advantageous dissipation of stress between the wedged fastener and the guide faces of the guide channel is brought about by the enlargement of the channel cross section. At the same time, the closure flap is displaced downward in the longitudinal direction of the stationary channel part, and the locking means between the stationary channel part and the holding part which is preferably provided at the lower end of the closure flap is therefore released automatically, with the result that the closure flap can then be opened without problems in order to remove the fastener. For the targeted adjustment of the eccentric shaft, a tool attachment piece for, for example, a hexagon socket can be provided, for example, on one of its end-side front faces, by means of which hexagon socket the eccentric shaft is rotated by approximately 90 degrees, in order to move the closure flap out of its closure position into the unlocked position.

It is provided according to one advantageous development of the invention that the eccentric shaft has two cylindrical end sections which are oriented coaxially with respect to one another and a center part which is arranged eccentrically with respect to the end sections, the closure flap being mounted rotatably on the center part of the eccentric shaft. The end sections of the eccentric shaft which preferably have identical diameters are received, in particular, in a rotary bearing which is configured as a sliding bearing, which end sections serve for receiving the eccentric shaft on the device according to the invention in a stationary manner. Correspondingly, in the case of a rotation of the eccentric shaft, the center part which is oriented eccentrically with respect to the end sections and has a greater diameter is moved on a circular path, and the closure flap which is likewise mounted rotatably via this is moved. It goes without saying that it would also be possible to provide a stationary rotary guide for the center part, which would then result in a movement of the end sections on a circular path and of the closure flap which is to be arranged on them.

An adjusting lever for disengaging the channel closure flap out of its locked position is arranged on the eccentric shaft. The use of an adjusting lever represents one structurally advantageous option for implementing a rotational movement on the eccentric shaft, without tools which are always to be carried separately being required. By means of the adjusting lever, in addition, the closure flap can be released on the stationary channel part with a relatively low expenditure of energy, there likewise being no impairment of the visibility of the free, lower end of the guide channel as a result of the arrangement of the adjusting lever at the upper end of the closure flap, which upper end has the pivoting bearing.

Moreover, it is provided that the adjusting lever is assigned a holding device which arrests the adjusting lever in the locked position of the closure flap. Automatic release of the adjusting lever and, at the same time, undesired movement of the closure flap out of its locked position can advantageously be avoided with the aid of a holding device, in an advantageous way. In the case of accidental contact with the adjusting lever, the holding device also ensures that said adjusting lever is fixed in a preferably horizontal position below a base plate which is provided on the device, as a result of which advantageously safe working with the device according to the invention can always be ensured.

Furthermore, it lies within the scope of the invention that the holding device is formed by means of at least one recess on the adjusting lever and a latching part which corresponds with the recess. The adjusting lever is preferably provided with a plurality of recesses for a latching function with the latching part in the locked position of the channel closure flap. This advantageously prevents undesired pivoting of the adjusting lever and associated, automatic release of the closure flap on the stationary channel part. Here, the recesses in the contour of the adjusting lever enter, in particular, into a positive connection with a latching part which is formed on a base plate of the device according to the invention, has undercuts, and with the aid of which advantageous arresting of the adjusting lever can be ensured.

As an alternative to the holding device which implements a positive connection, it is provided that the holding device is configured as a magnetic closure which has at least one permanent magnet which is assigned a counterpart which is formed on the adjusting lever. The configuration as a magnetic closure represents one structurally advantageous option for implementing a holding device. Here, the magnetic closure exerts its greatest holding force, in particular, in the case of direct contact between the permanent magnet and the counterpart which is formed on the adjusting lever. As soon as the holding force between the permanent magnet and the counterpart is overcome at the beginning of an adjusting movement of the adjusting lever, the adjusting lever can always advantageously be moved freely. Furthermore, an operationally reliable long term function of the holding device according to the invention is ensured with the aid of the permanent magnet which is used and the counterpart on the adjusting lever, which counterpart is preferably configured as a metal part.

It is provided according to one development of the invention that the eccentric shaft is mounted in a sprung or damped manner at least one of its end sections. The sprung or damped mounting of the end sections of the eccentric shaft provides that a spring/damping element is arranged on a circumferential or casing face of a respective cylindrical end section, which spring/damping element exerts, in particular, a pressure force in the direction of a guide face of the rotary bearing, which guide face is arranged so as to lie opposite the spring/damping element. In this way, in particular, the bearing play which is required for the rotational movement of the eccentric shaft in the rotary bearings is to be compensated for, and disadvantageously acting relative movements of the various components with respect to one another are to be avoided during the handling of the device according to the invention, in particular during setting of the fasteners.

On its circumferential face, at least one of the cylindrical end sections of the eccentric shaft has a planar support face which corresponds with a respective spring/damping element, as a result of which the spring/damping element has an advantageously enlarged acting face. This ensures optimum transmission of the pressure force which is generated by the spring/damping element, as a result of which an advantageous surface pressure can be achieved within the rotary bearing, both in the locked position of the closure flap and during the unlocking operation. The planar support faces on the cylindrical end sections of the eccentric shaft are formed, in particular, on a downwardly pointing region of the circumferential face, the surface planes of which are oriented approximately horizontally in the locked position of the closure flap, and a respective spring/damping element which corresponds with a support face exerts a force on the eccentric shaft, which force is directed in parallel in the direction of the locking movement of the closure flap.

Another development of the invention provides that each holding part of the closure flap is formed as a hook-shaped positively locking element which in each case engages behind an obliquely running sliding face on a laterally formed web of the stationary channel part. The formation of hook-shaped positively locking elements and of sliding faces which run at a predefined angle in the direction of extent of the channel part represents an advantageously simple option for the structural design of a locking means, in particular at the lower end of the components which form the guide channel and fix to one another. As a result of the relative movement between the components to be locked to one another, which relative movement is produced by means of the eccentric shaft, a surface pressure which acts perpendicularly with respect to the bearing faces is brought about at the same time between the channel part and the closure flap, in addition to the advantageously acting positively locking connection. This ensures optimum locking and, at the same time, also functionally reliable guidance within the guide channel of the fasteners which are always to be set one after another and of the striking pin which drives a respective fastener.

Figure 2:
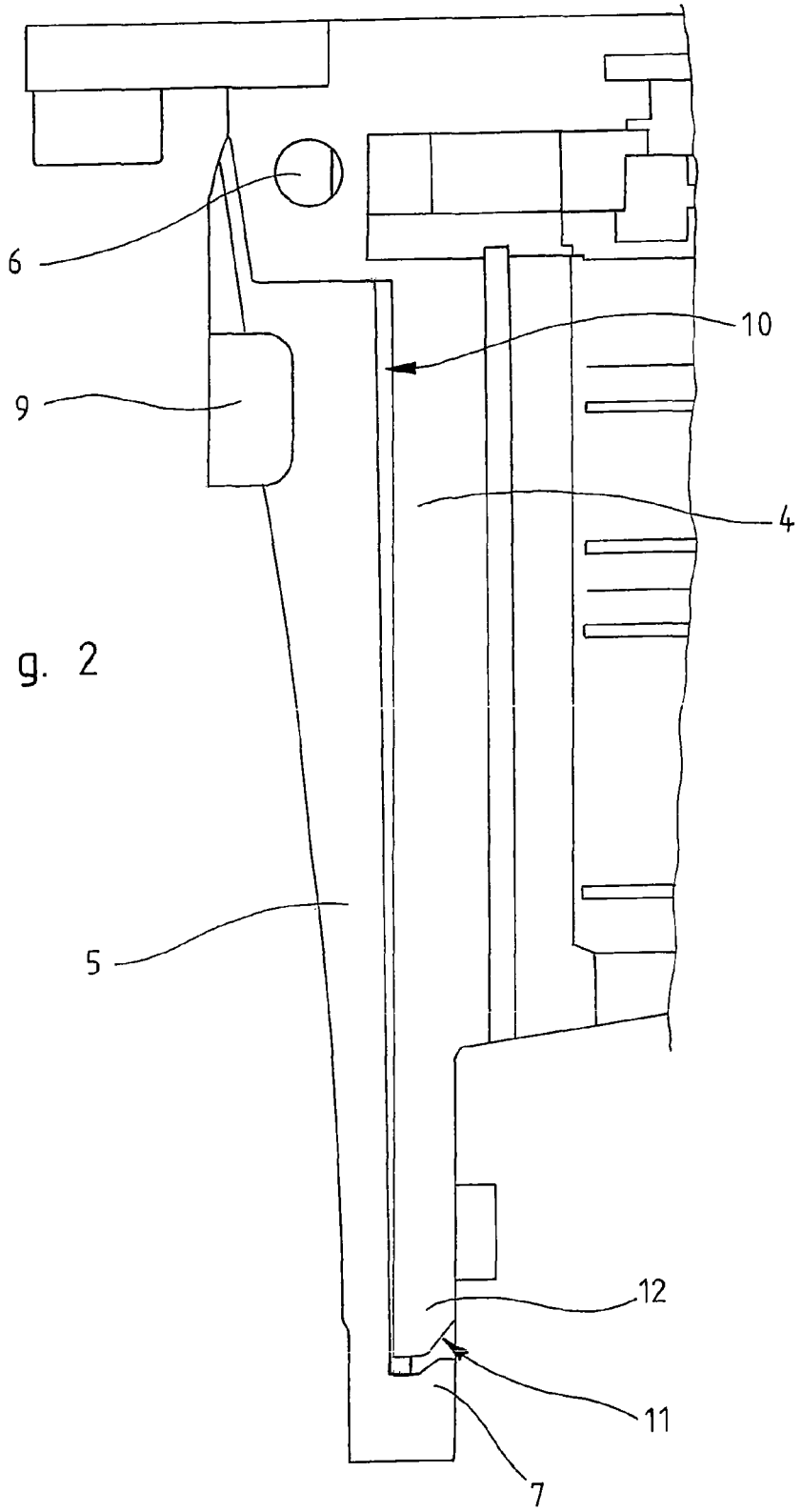
Figure 3:
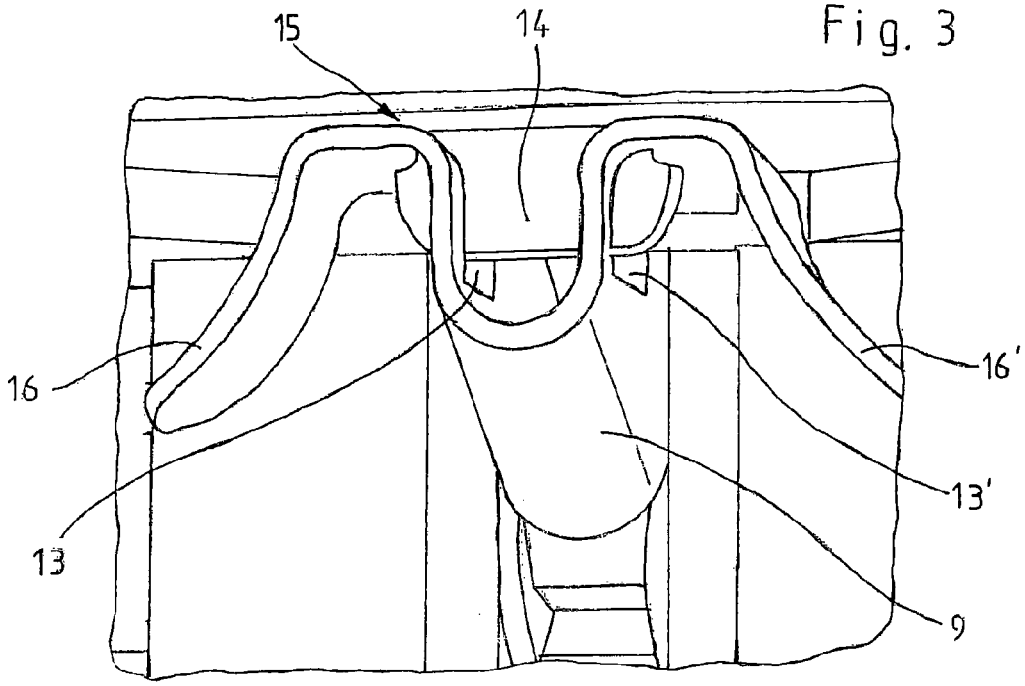
Figure 4:
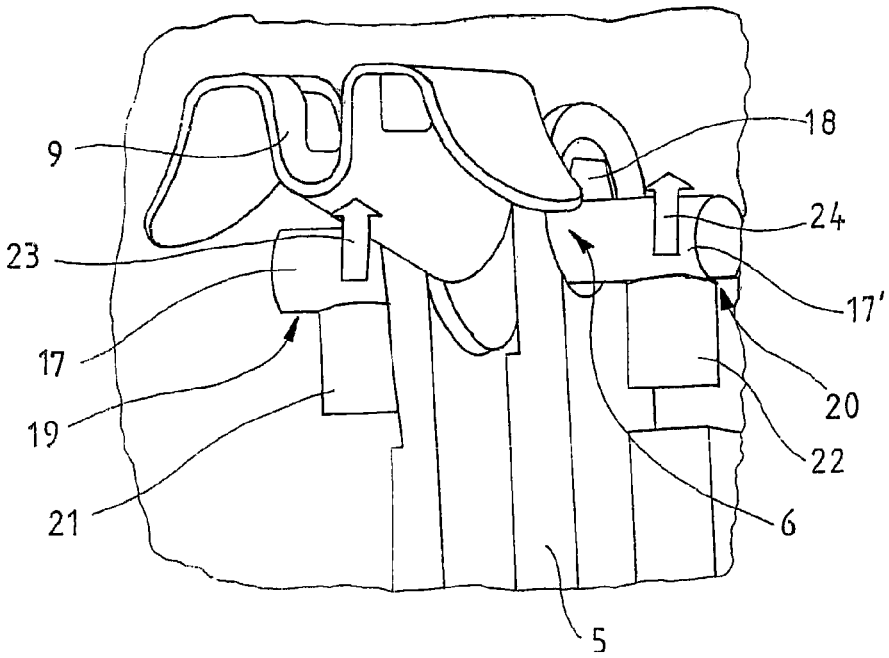
Figure 5:
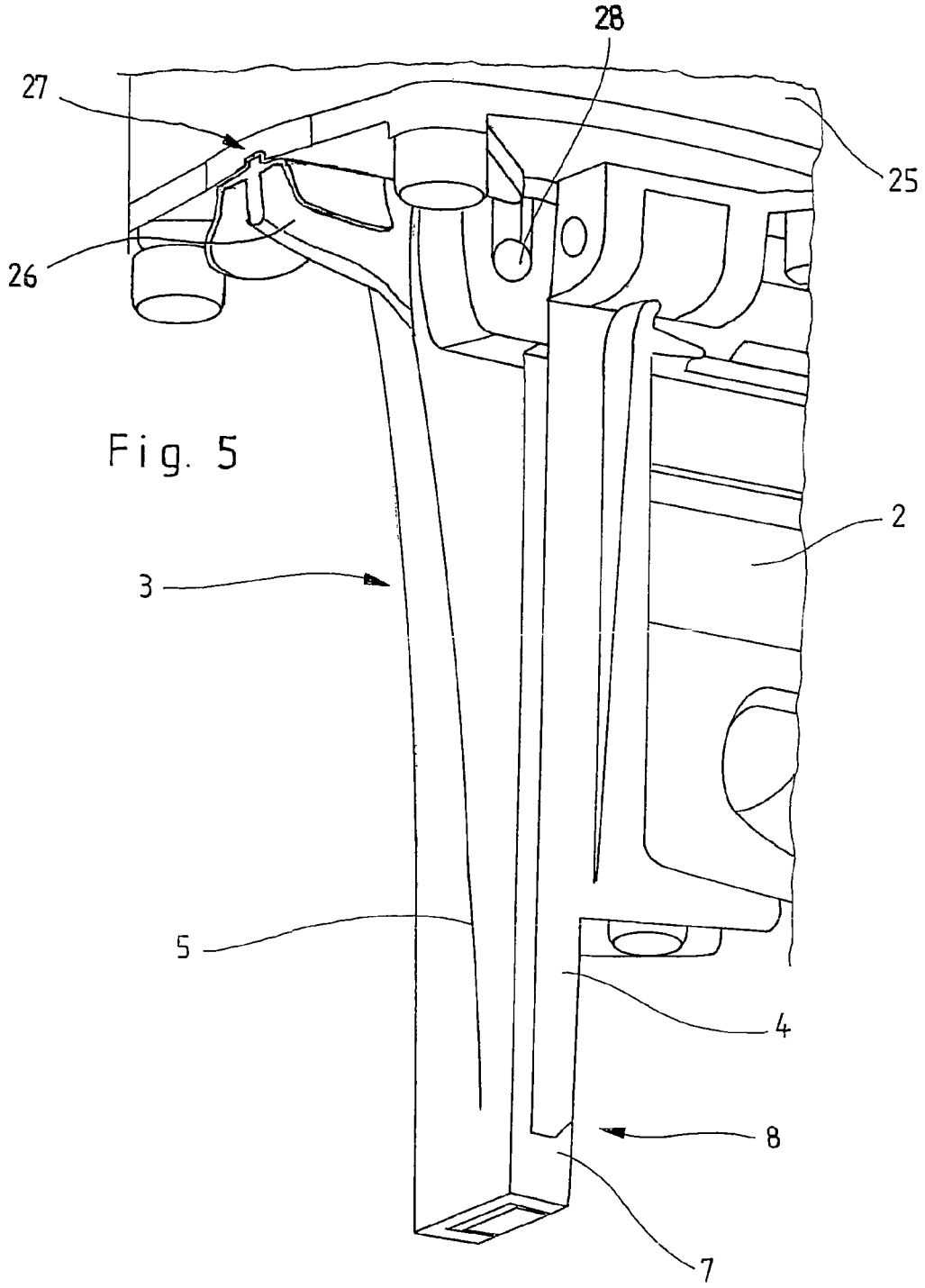

One exemplary embodiment of the invention, from which further inventive features result, is shown in the drawing, in which:

FIG. 1 shows a perspective partial view of a first embodiment of a device having a guide channel which is formed according to the invention, FIG. 2 shows a side view of the guide channel with an unlocked closure flap, FIG. 3 shows a detailed view of an adjusting lever which is latched in the locked position of the closure flap, FIG. 4 shows a detailed view of an eccentric shaft according to the invention with the adjusting lever arranged thereon and the closure flap, FIG. 5 shows a perspective partial view of a second exemplary embodiment of the device, FIG. 6 shows a perspective detailed view of an alternative embodiment for a holding device which arrests the adjusting lever, and FIG. 7 shows a detailed view of a second embodiment of an eccentric shaft according to the invention.

1 denotes, in particular, a driving unit for setting clip-like or nail-like fasteners, which has a striking pin (not shown in greater detail) for the fasteners which are accommodated in a magazine 2, parts of the striking pin and a respective fastener to be set by means of the striking pin being guided at least in sections in a channel 3. Here, the guide channel 3 is formed from at least one stationary channel part 4 and a channel closure flap 5 which is arranged such that it can be moved pivotably with respect to the channel part. Furthermore, the channel closure flap 5 is received at its upper end by means of an eccentric shaft 6 which can be adjusted about the rotational axis, and at the same time at least one holding part 7 which corresponds with the channel part 4 for forming a locking means 8 is formed at the lower end of the closure flap 5. In order for it to be possible to adjust the eccentric shaft 6 relatively simply, and therefore in order to move the closure flap 5 out of its locked position into an unlocked position, an adjusting lever 9 is arranged fixedly on the eccentric shaft 6 so as to rotate with it.

FIG. 2 shows the closure flap in its unlocked position, the adjusting lever 9 having moved out of its upper latching position. The receiving of the closure flap 5 by means of an eccentric shaft 6 produces a gap 10 after unlocking in the upper region between the closure flap 5 and the channel part 4, the closure flap at the same time being moved downward along the channel part, with the result that the holding part 7 of the closure flap 5 is no longer in engagement with a sliding face 11 of a, for example, laterally formed web 12 of the channel part 4. The locking function at the lower end of the guide channel 3 is therefore canceled. In order to open the closure flap 5, it can then be pivoted upward by approximately 90 degrees, which makes unimpeded access into the interior of the guide channel 3 possible.

FIG. 3 shows a perspective view of the adjusting lever 9 which has recesses 13, 13' for a latching part 14, by means of which recesses 13, 13' a holding device 15 is formed for the adjusting lever 9 and therefore, in particular, undesired actuation or automatic pivoting of the adjusting lever 9 which holds the closure flap 5 in its locked position is prevented. In order to cancel the latching function between the adjusting lever 9 and the latching part 14, the wing-like grip parts 16, 16' of the adjusting lever 9 can be actuated by hand, with the result that there is no longer the positively locking connection between the latching part 14 and the recesses 13, 13' of the adjusting lever 9, and the latter can be pivoted downward.

FIG. 4 shows a detailed view of the eccentric shaft 6 with the adjusting lever 9 arranged on it and the channel closure flap 5 which is received such that it can be moved rotationally. The eccentric shaft 6 has two cylindrical end sections 17, 17' of the same diameter which are oriented coaxially with respect to one another and between which an eccentrically arranged center part 18 is formed. Both the closure flap 5 and the adjusting lever 9 are arranged on the center part 18 of the eccentric shaft 6, the closure flap being received rotatably, whereas the adjusting lever is connected fixedly to the center part so as to rotate with it. The cylindrical end sections 17, 17' serve, in particular, for mounting the eccentric shaft 6 on the driving unit in a rotationally movable manner. Furthermore, the end sections 17, 17' in each case have a planar support face 19, 20, below which damping elements 21, 22 are arranged. In particular, a pressure force which acts in the direction of the arrows 23, 24 is generated by means of the damping elements 21, 22 which are formed, for example, from an elastomer, as a result of which the bearing play between the guide faces of the components which move toward one another is overcome or canceled, and undesired component movements on the tool are advantageously avoided long term during the handling of the driving unit 1.

FIG. 5 and FIG. 6 show an alternative exemplary embodiment of a device 25 according to the invention with a structurally modified adjusting lever 26 which is assigned a holding device 27 which generates a magnetic force action. When the adjusting lever 26 is pivoted into an approximately perpendicularly downwardly directed position, an eccentric shaft 28 is likewise turned, as a result of which the closure flap 5 which is mounted rotatably on the eccentric shaft 28 is then in its unlocked position, as likewise shown in FIG. 2, and can therefore be opened without problems. All components which are not modified structurally and therefore have the same method of operation are denoted by the same reference numerals.

FIG. 6 depicts a perspective detailed view of the adjusting lever 26 which is assigned the holding device which is configured as a magnetic closure, as a result of which, in particular, undesired actuation or automatic pivoting of the adjusting lever 26 which holds the closure flap 5 in its locked position is prevented. The holding device 27 is configured by means of a permanent magnet 29 and a counterpart 30 on the adjusting lever 26. In order to cancel the holding function of the magnetic closure and in order for it to be possible to pivot or rotate the adjusting lever 26 downward together with the eccentric shaft 28, a counterforce which cancels the holding force of the holding device 27 which is configured as a magnetic closure is to be produced at the wing-like grip parts 31, 31' of the adjusting lever 26.

FIG. 7 shows, in particular, a detailed view of the eccentric shaft 28 which is used here, as a further, possible embodiment which likewise has two cylindrical end sections 32, 32' of identical diameter which are oriented coaxially with respect to one another and a center part 33 which is arranged eccentrically with respect thereto and has a greater diameter than the end sections. However, this embodiment of the eccentric shaft 28 has no planar support faces on its end sections. Once again, in particular, damping elements 34, 35 of cylindrical configuration are arranged below the end sections 32, 32', which damping elements 34, 35 produce a pressure force, in each case via their circumferential faces, in the direction of the arrows 23, 24 on the corresponding associated circumferential face of a respective end section 32, 32' of the eccentric shaft 28. Here, the axes of the end sections 32, 32' extend transversely with respect to the longitudinal axes of the damping elements 34, 35.

The invention claimed is:

1. A device for setting fasteners, in particular a driving unit, having at least one striking pin for a respective fastener, the striking pin and the fastener to be set by means of the striking pin being guided at least in sections in a channel which is formed from at least one stationary channel part and a channel closure flap which is arranged such that the closure flap can be moved pivotably with respect to the channel part, characterized in that the channel closure flap is received at an upper end by means of an eccentric shaft which can be adjusted about a rotational axis, and in that the closure flap has at least one holding part which corresponds with the channel part in order to form a locking means.

2. The device as claimed in claim 1, characterized in that the eccentric shaft has two end sections which are oriented coaxially with respect to one another and a center part which is arranged eccentrically with respect to the end sections, the closure flap being mounted rotatably on the center part.

3. The device as claimed in claim 2, characterized in that, on its circumferential face, at least one of the end sections of the eccentric shaft has a planar support face which corresponds with a respective spring/damping element.

4. The device as claimed in claim 1, characterized in that an adjusting lever for disengaging the closure flap out of a locked position of the closure flap is arranged on the eccentric shaft.

5. The device as claimed in claim 4, characterized in that the adjusting lever is assigned a holding device which arrests the adjusting lever in the locked position of the closure flap.

6. The device as claimed in claim 5, characterized in that the holding device is formed by means of at least one recess on the adjusting lever and a latching part which corresponds with the recess.

7. The device as claimed in claim 5, characterized in that the holding device is configured as a magnetic closure which has at least one permanent magnet which is assigned a counterpart which is formed on the adjusting lever.

8. The device as claimed in claim 1, characterized in that the eccentric shaft is mounted in a sprung manner at at least one of an end section of the eccentric shaft.

9. The device as claimed in claim 1, characterized in that each holding part of the closure flap is formed as a hook-shaped positively locking element which engages behind an obliquely running sliding face on a web of the channel part.

10. The device as claimed in claim 1, wherein the eccentric shaft has a cross-section on a plane normal to a longitudinal axis thereof that has an outer perimeter that is non-circular.

11. The device as claimed in claim 1, wherein the eccentric shaft has a cross-section on a plane normal to a longitudinal axis thereof that has an outer perimeter that has a first section having a radius of curvature and a second section having a geometry different from that of the first section.

12. The device as claimed in claim 1, wherein the eccentric shaft has a cross-section on a plane normal to a longitudinal axis thereof that has an outer perimeter that has a first section that is curved and a second section that is straight.

13. A device for setting fasteners, having at least one striking pin for a respective fastener, the striking pin and the fastener to be set by means of the striking pin being guided at least in sections in a channel which is formed from at least one stationary channel part and a channel closure flap, wherein the device is configured such that the channel closure flap moves pivotably with respect to the channel part, wherein the channel closure flap is received at an upper end of the channel closure flap by means of an eccentric shaft which can be adjusted about a rotational axis of the eccentric shaft, and in that the closure flap has at least one holding part which corresponds with the channel part in order to form a locking means.

14. The device as claimed in claim 13, wherein the device is a driving unit.

15. The device as claimed in claim 13, characterized in that the eccentric shaft has two end sections which are oriented coaxially with respect to one another and a center part which is arranged eccentrically with respect to the end sections, the closure flap being mounted rotatably on the center part.

16. The device as claimed in claim 15, characterized in that, on its circumferential face, at least one of the end sections of the eccentric shaft has a planar support face which corresponds with a respective spring/damping element.

17. The device as claimed in claim 13, characterized in that an adjusting lever for disengaging the closure flap out of a locked position of the closure flap is arranged on the eccentric shaft.

18. The device as claimed in claim 17, characterized in that the adjusting lever is assigned a holding device which arrests the adjusting lever in the locked position of the closure flap.

19. The device as claimed in claim 18, characterized in that the holding device is formed by means of at least one recess on the adjusting lever and a latching part which corresponds with the recess.

20. The device as claimed in claim 18, characterized in that the holding device is configured as a magnetic closure which has at least one permanent magnet which is assigned a counterpart which is formed on the adjusting lever.

21. The device as claimed in claim 13, characterized in that the eccentric shaft is mounted in a sprung manner at at least one of an end section of the eccentric shaft.

22. The device as claimed in claim 13, characterized in that each holding part of the closure flap is formed as a hook-shaped positively locking element which engages behind an obliquely running sliding face on a web of the channel part.

23. The device as claimed in claim 13, characterized in that the eccentric shaft is mounted in a damped manner at at least one of an end section of the eccentric shaft.

24. The device as claimed in claim 13, wherein the eccentric shaft is mounted in a damped manner at at least one of an end section of the eccentric shaft.

25. The device as claimed in claim 13, wherein the eccentric shaft has a cross-section on a plane normal to a longitudinal axis thereof that has an outer perimeter that is non-circular.

26. The device as claimed in claim 13, wherein the eccentric shaft has a cross-section on a plane normal to a longitudinal axis thereof that has an outer perimeter that has a first section having a radius of curvature and a second section having a geometry different from that of the first section.

27. The device as claimed in claim 10, wherein the eccentric shaft has a cross-section on a plane normal to a longitudinal axis thereof that has an outer perimeter that has a first section that is curved and a second section that is straight.

* * * * *